US005218851A

United States Patent [19]

Imae

[11] Patent Number: 5,218,851

[45] Date of Patent: Jun. 15, 1993

[54] MANDREL MILL CAPABLE OF PREVENTING STRIPPING MISS

[75] Inventor: Toshio Imae, Chiba, Japan

[73] Assignee: Kawasaki Steel Corporation, Kobe, Japan

[21] Appl. No.: 898,436

[22] Filed: Jun. 15, 1992

[30] Foreign Application Priority Data

Jun. 21, 1991 [JP] Japan ..... 3-175902

[51] Int. Cl.[5] ..... B21B 17/10

[52] U.S. Cl. ..... 72/208; 72/370

[58] Field of Search ..... 72/97, 208, 209, 235, 72/370

[56] References Cited

U.S. PATENT DOCUMENTS 1,858,990 5/1932 Foren ..... 72/208
2,074,271 3/1937 Peters ..... 72/209
5,156,035 10/1992 Lampe et al. ..... 72/370

FOREIGN PATENT DOCUMENTS 0104207 6/1984 Japan ..... 72/235
0043805 9/1985 Japan ..... 72/235
0045408 2/1987 Japan ..... 72/208

*Primary Examiner*—Lowell A. Larson
*Assistant Examiner*—Michael J. McKeon
*Attorney, Agent, or Firm*—Dvorak and Traub

[57] ABSTRACT

A mandrel mill for rolling a tubing in a pass between a mandrel bar and a plurality of serially arranged roll stands. Each roll stand has a plurality of pairs of grooved rolls whose grooves are paired to define a part of the pass. The grooves of the rolls of a first roll stand define a hole having a circumference of not more than 1.12 times the outer circumference of a tubing at the exit of the final roll stand. The grooves of the second-stand rolls define a hole having a circumference of not more than 1.06 times that outer circumference, and those of the third-stand rolls define a hole having a circumference of not more than 1.02 times that outer circumference. Thus, the mandrel mill is capable of preventing stripping miss even when the billet is of a high-alloy steel.

1 Claim, 3 Drawing Sheets

HOLE CIRCUMFERENCE ≡
$4(R_1\alpha_1 + R_2\alpha_2 + R_4\alpha_4)$

MANDREL MILL CAPABLE OF PREVENTING STRIPPING MISS

BACKGROUND OF THE INVENTION

1. Field of the Invention

The present invention relates to a mandrel mill capable of preventing stripping miss which can take place during the production of a seamless tubing.

2. Description of the Related Art

A method of producing a seamless tubing comprises piercing a heated billet with a piercer, and rolling the inner surface of the pierced material with a mandrel mill, which is followed by finish rolling.

A mandrel mill employed in such a rolling process generally includes, as shown in FIG. 3, a plurality (usually 5 to 8) of roll stands 1, each having a plurality of pairs of grooved rolls 2 and 2'. The plurality of roll stands 1 are serially arranged with the axes of adjacent roll pairs extending perpendicular to each other, thereby defining a serial arrangement of the grooves of the rolls. A mandrel bar 3 is disposed in and extended through the serial arrangement of the grooves. The mandrel bar 3 rolls the inner surface of a tubing material 4.

When rolling is being performed with such a mandrel mill, the inner surface of the tubing material may be brought into tight contact with the mandrel bar. After the rolling, the mandrel bar and the tubing material may be stuck together, making it impossible to withdraw the mandrel from the tubing material. Such a phenomenon is called a "striping miss".

A stripping miss is more likely to occur when the tubing is made of a high-alloy steel than when it is made of an ordinary carbon steel. A high-alloy steel has a relatively great coefficient of thermal expansion. In the former case, therefore, the tubing material has a relatively great heat shrinkage, and it relatively easily engages in tight contact with the mandrel bar. In addition, the tubing material has a relatively great deformation resistance, and it exerts a relatively great force with which the tubing material, in tight contact with the mandrel bar, fastens onto the mandrel bar. Thus, a stripping miss might be expected to occur when dealing with a high-alloy steel.

Once a stripping miss occurs, the operation of the rolling line must be suspended. The tubing material with the mandrel bar stuck therein is taken out of the line, and, in order to separate the tubing material from the mandrel bar, the joint between them has to be melted away with acetylene gas flame or the like. The separated tubing material becomes scrap. On the other hand, the mandrel bar cannot be used until the separating operation is completed. Thus, a stripping miss can seriously trouble the continuing operation of a mandrel mill.

The above-described problem of a mandrel bar may similarly arise in the case of a retained mandrel mill in which, during rolling, the rear end of the mandrel bar is retained in such a manner that movement of the mandrel bar is forcibly controlled at a certain fixed speed lower than the speed of the material at the exit of the mill.

Various methods have been proposed with a view to preventing scratch-formation on the inner surface of the tubing material or preventing stripping miss.

One of the most generally-known methods comprises adjusting the speed of rotation of the rolls of adjacent stands to adjust the stress applied to the parts of the tubing material between adjacent stands, so as to control the cross-sectional configuration of the tubing material. For instance, "Basic Load Characteristics and Deformation Characteristics" (on pages 545 to 548 of "Theses of 1984 Spring Meeting on Plastic Working") shows with regard to two-stand continuous rolling, the art of changing the speed of rotation of the rolls of the first stand so as to control the tensile force between the first and the second stands as well as the outer diameter (width) of the tubing material at the exit of the second stand.

Japanese Patent Laid-open No. 60-46805 proposes the art of effecting an appropriate rolling reduction at the final stand so as to form a relief portion in the roll grooves of the final stand, the thus formed clearance between the mandrel bar and the inner surface of the tubing material enabling an easy drawing of the mandrel bar.

Japanese Patent Publication No. 59-24885 proposes the art of disposing a forming roll, which may be either a driven or non-driven type, between adjacent stands of a mandrel mill, and causing an edge portion of the tubing material projecting from the previous stand to be gripped by the forming roll, so that an appropriate clearance is provided between the inner surface of the tubing material and the mandrel bar.

With the method shown in the above-identified thesis, although it is possible to control the configuration of a central portion of the tubing material which can be held simultaneously by a plurality of stands, it is not possible to control the configuration of the forward and rearward end portions of the tubing material which cannot be subjected to a sufficient compression force between a plurality of stands. It is generally known that the forward and rearward end portions of a tubing material tend to be in an under fill condition wherein the entire inner circumference of the material contacts the mandrel bar.

With the method proposed in Japanese Patent Laid-open No. 60-46805, if the entire inner circumference of the tubing material at the entrance of the final stand contacts the mandrel bar, it is not possible to form an appropriate clearance between the mandrel bar and the inner surface of the tubing material regardless of how the rolling reduction at the final stand is adjusted or how a relief portion is formed in the roll grooves of the final stand.

The method proposed in Japanese Patent Publication No. 59-24885 is effective when the tubing material at the exit of the previous stand has a projecting edge portion. However, when the tubing material is in contact with the mandrel bar throughout the circumference thereof and simultaneously has no projecting edge portion, gripping with a forming roll does not make it possible to provide an appropriate clearance between the inner surface of the tubing material and the mandrel bar.

Thus, none of the above-described art is able to form an appropriate clearance between the inner surface of the tubing material and the mandrel bar when the entire inner circumference of the rearward end portion of the tubing material contacts the mandrel bar.

SUMMARY OF THE INVENTION

The present invention is directed toward overcoming said problem of a mandrel mill. An object of the present invention is to assure the formation of an appropriate clearance between the mandrel bar and the tubing material even at the forward and rearward end portions thereof.

The present invention arranges the grooves of the grooved rolls of a plurality of serially arranged roll stands of a mandrel mill so that an appropriate clearance is formed between the mandrel bar and the tubing material over the full length of the tubing material.

In rolling with a mandrel mill, it is difficult to form an appropriate clearance between the forward and rearward end portions of a tubing material, on one hand, and the mandrel bar, on the other, by controlling the speed of rotation of rolls. The present invention has been made on the basis of the finding that, in order to solve this problem, it is effective to conduct rolling while maintaining appropriate outer diameters of the tubing material at upstream stands of a mandrel mill.

Thus, the present invention provides a mandrel mill capable of preventing stripping miss, comprising: a plurality of roll stands serially arranged, each roll stand comprising a plurality of pairs of grooved rolls whose grooves are paired, the plurality of roll stands defining a serial arrangement of the paired grooves; and a mandrel bar disposed in and extended through the serial arrangement in a spaced relationship with the grooved rolls, the mandrel bar cooperating with the rolls to define therebetween a pass for rolling a tubing therein. The plurality of stands include a first stand whose rolls have grooves defining a hole of a circumference of not less than 1.12 times the outer circumference of a tubing at the exit of the final stand, a second stand whose rolls have grooves defining a hole of a circumference of not less than 1.06 times the outer circumference, and a third stand whose rolls have grooves defining a hole of a circumference of not less than 1.02 times the outer circumference.

DETAILED DESCRIPTION OF THE PREFERRED EMBODIMENT

What most strongly influences the outer circumference of a tubing material at the exit of the final stand of a mandrel mill is the circumference of holes defined by the grooves of the grooved rolls of the first to third stands of the mandrel mill (the circumference will hereinafter be referred to as the "hole circumference").

In order that an appropriate clearance be formed between the mandrel bar and a tubing material passed through the final stand, it is necessary that the ratio of the hole circumference of the rolls of the first stand to the outer circumference of the tubing material at the exit of the final stand (hole circumference ratio) be not less than 1.12. If the hole circumference ratio of the first-stand rolls is below this value, it is not possible to form an appropriate clearance between the forward and rearward end portions of the tubing material and the mandrel bar regardless of how the hole circumference ratios of the rolls of the subsequent stands are varied.

Figure 4:
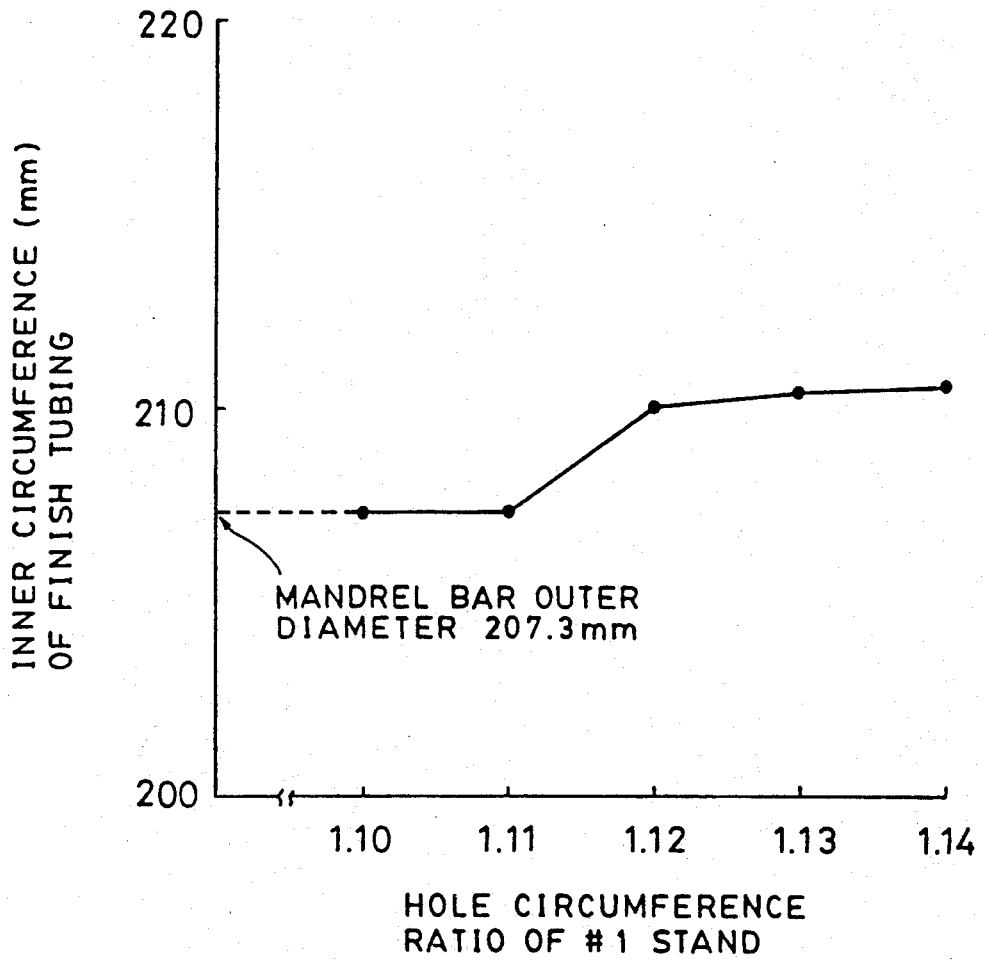
FIG. 4 is a graph for illustrating the manner in which the ratio of the hole circumference of the rolls of a first stand influences the circumference of a tubing at the exit of the final stand.

FIG. 4 shows the relationship between the hole circumference ratio of the first-stand rolls of the mandrel mill and the inner circumference of the rearward end portion of the tubing material at the exit of the final stand after the cooling of the tubing material. The data shown in FIG. 4 has been obtained from rolling experiments conducted under the same conditions as those shown in Table 1, described later. In these experiments, the hole circumference ratio of the first-stand rolls was varied to five different standards. It is understood from FIG. 4 that where the hole circumference ratio of the first-stand rolls is less than 1.12, the inner circumference of the tubing material is substantially equal to the outer circumference of the mandrel bar, and it is not possible to form an appropriate clearance between the inner surface of the tubing material and the mandrel bar. Where the hole circumference ratio of the first-stand rolls is equal to or greater than 1.12, it is possible to form an appropriate clearance between the inner surface of the tubing material and the mandrel bar.

If the hole circumference ratio of the rolls of the second stand is too small as compared to that of the rolls of the first stand, the tubing material may not be properly fit into the roll grooves at the second stand, thereby causing scratches, etc. to be formed on the outer surface of the tubing material. In order to avoid this risk, when the hole circumference of the first-stand rolls is not less than 1.12 times the outer circumference of the tubing at the exit of the final stand, it is necessary that the hole circumference of the second-stand rolls be not less than 1.06 times the same outer circumference. For the same reason, under the above condition, it is necessary that the hole circumference of the rolls of the third stand be not less than 1.02 times the same outer circumference.

Figure 2:
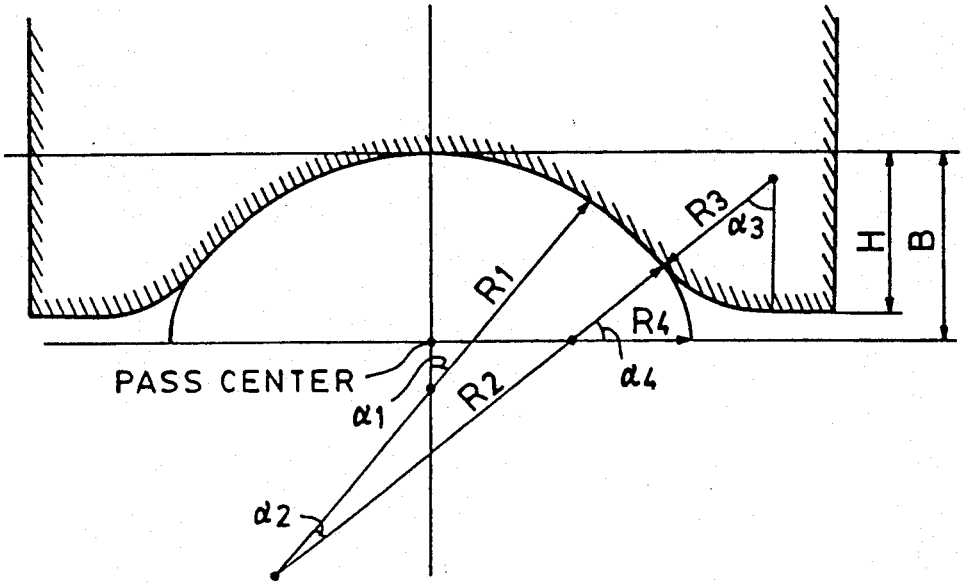
FIG. 2 is a view showing the definition of a hole circumference of rolls.
Figure 3:
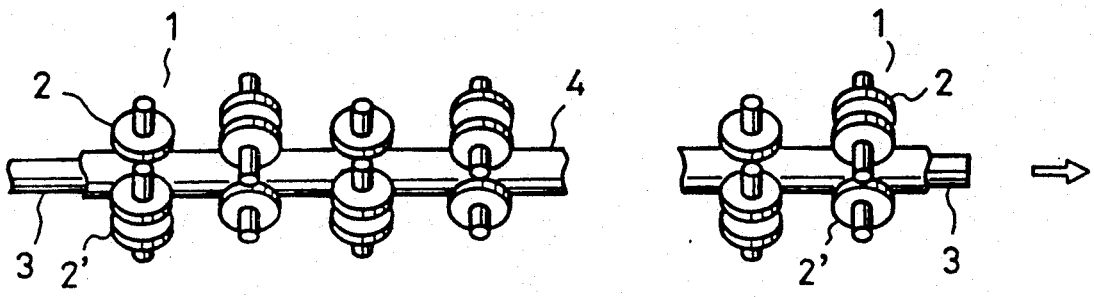
FIG. 3 is a view schematically showing a mandrel mill.

According to the present invention, the hole circumference of rolls is defined as follows (see FIG. 2):

In general, the groove of a roll for a mandrel mill is designed as a combination of three circular arcs. The inner perimeter of the groove of the roll is determined by five variables, namely, these circular arcs (represented by $R_1$, $R_2$ and $R_3$), the regional angle $\alpha_1$ corresponding to the circular arc $R_1$, and the depth H of the groove, are determined. That is, the regional angle $\alpha_2$ corresponding to the circular arc $R_2$ and the regional angle $\alpha_3$ corresponding to the circular arc $R_3$ are determined as expressed by the following formulae (1) and (2):

$$\alpha_3=\cos^{-1}[\{(R_2-R_1)\cos\alpha_1+R_1+R_3-H\}/(R_2+R_3)] \quad (1)$$

$$\alpha_2=\alpha_3-\alpha_1 \quad (2)$$

In determining the hole circumference of a pair of such rolls, the respective inner perimeters of the grooves of the rolls are smoothly connected to each other at the circular arcs $R_4$. Each of the circular arcs $R_4$ has a point of contact with the mated circular arc $R_3$, and has a center on the center line serving as the boundary between the paired grooves of the paired rolls. If the distance between the respective bottoms of the paired grooves of the rolls is represented by 2B, the circular arc $R_4$ and its regional angle $\alpha_4$ are determined as expressed by the following formulae (3) and (4):

$$\alpha_4=\pi/2-\alpha_3 \quad (3)$$

1) were used. The results of the experiments are shown in Table 2.

TABLE 1

| EXPERIMENT CONDITIONS | | | | | | |
|---|---|---|---|---|---|---|
| TYPE AND DIMENSIONS OF TUBING MATERIAL | SUS304; OUTER DIAMETER: 88.9 mm; WALL THICKNESS: 9.0 mm; LENGTH: 1500 mm | | | | | |
| TARGET DIMENSIONS AT EXIT OF FINAL STAND | OUTER DIAMETER: 74.0 mm; WALL THICKNESS: 3.0 mm; LENGTH: 5064 mm | | | | | |
| SPECIFICATIONS OF MANDREL BAR | SKD61; OUTER DIAMETER: 66.0 mm; length: 10000 HISTORY: HAS BEEN USED AT LEAST 200 TIMES | | | | | |
| BAR LUBRICANT | WATER-DISPERSABLE GRAPHITE-TYPE LUBRICANT | | | | | |
| HEATING TEMPERATURE | 1220° C. ± 10° C. (ACTUAL HEATING FURNACE TEMPERATURE) | | | | | |
| ROLLING TEMPERATURE (ACTUAL VALUES) | 1050° C. AT MILL ENTRANCE; 950° C. AT MILL EXIT | | | | | |
| NUMBER OF STANDS | 5 | | | | | |
| ROLLING SPEED | 295 mm/sec AT MILL ENTRANCE; 100 mm/sec AT MILL EXIT | | | | | |
| ARRANGEMENT OF ROLL GROOVES | STAND NO. | #1 | #2 | #3 | #4 | #5 |
| PRESENT INVENTION | HOLE CIRCUMFERENCE (mm) | 260.4 | 246.5 | 237.2 | 237.2 | 232.5 |
| | HOLE CIRCUMFERENCE RATIO | 1.12 | 1.06 | 1.02 | 1.02 | 1.00 |
| COMPARISON MILL | HOLE CIRCUMFERENCE (mm) | 255.8 | 244.1 | 237.2 | 237.2 | 232.5 |
| | HOLE CIRCUMFERENCE RATIO | 1.10 | 1.05 | 1.02 | 1.02 | 1.00 |

TABLE 2

| RESULTS OF EXPERIMENTS | | | |
|---|---|---|---|
| | OUTER CIRCUMFERENCE OF REARWARD END OF TUBINGS AFTER COOLING | BAR DRAWING LOAD (tons) | NUMBER OF TUBINGS WITH SCRATCHED INNER SURFACE |
| PRESENT INVENTION | 229 ± 1 mm (FOR 50 SAMPLES) | LESS THAN 1 | 0 OUT OF 50 SAMPLES |
| COMPARISON MILL | 226 ± 1 mm (FOR 50 SAMPLES) | APPROX. 10 | 10 OUT OF 50 SAMPLES |

$$R_4=(B-H+R_3)/\cos\alpha_3-R_3 \quad (4)$$

The hole circumference of the rolls is expressed as follows:

$$\text{Hole circumference}\equiv 4\,(R_{1\alpha 1}+R_{2\alpha 2}+R_{4\alpha 4}) \quad (5)$$

According to the present invention, in a serial arrangement of paired grooves of rolls of a mandrel mill, the circumferences of the holes defined by the paired grooves of the rolls of upstream stands have certain lower limit values. This makes it possible to form an appropriate clearance between the mandrel bar and a tubing material even at the forward and rearward end portions of the tubing material, the entire inner circumferences of which have hitherto tended to contact the mandrel bar. Therefore, it is possible to prevent the formation of scratches on the inner surface of the tubing material or the occurrence of stripping miss. This feature enables a high-alloy steel having a relatively high heat-shrinkage ratio and a relatively great deformation resistance to be easily rolled with a mandrel mill.

EXAMPLE 1

Figure 1:
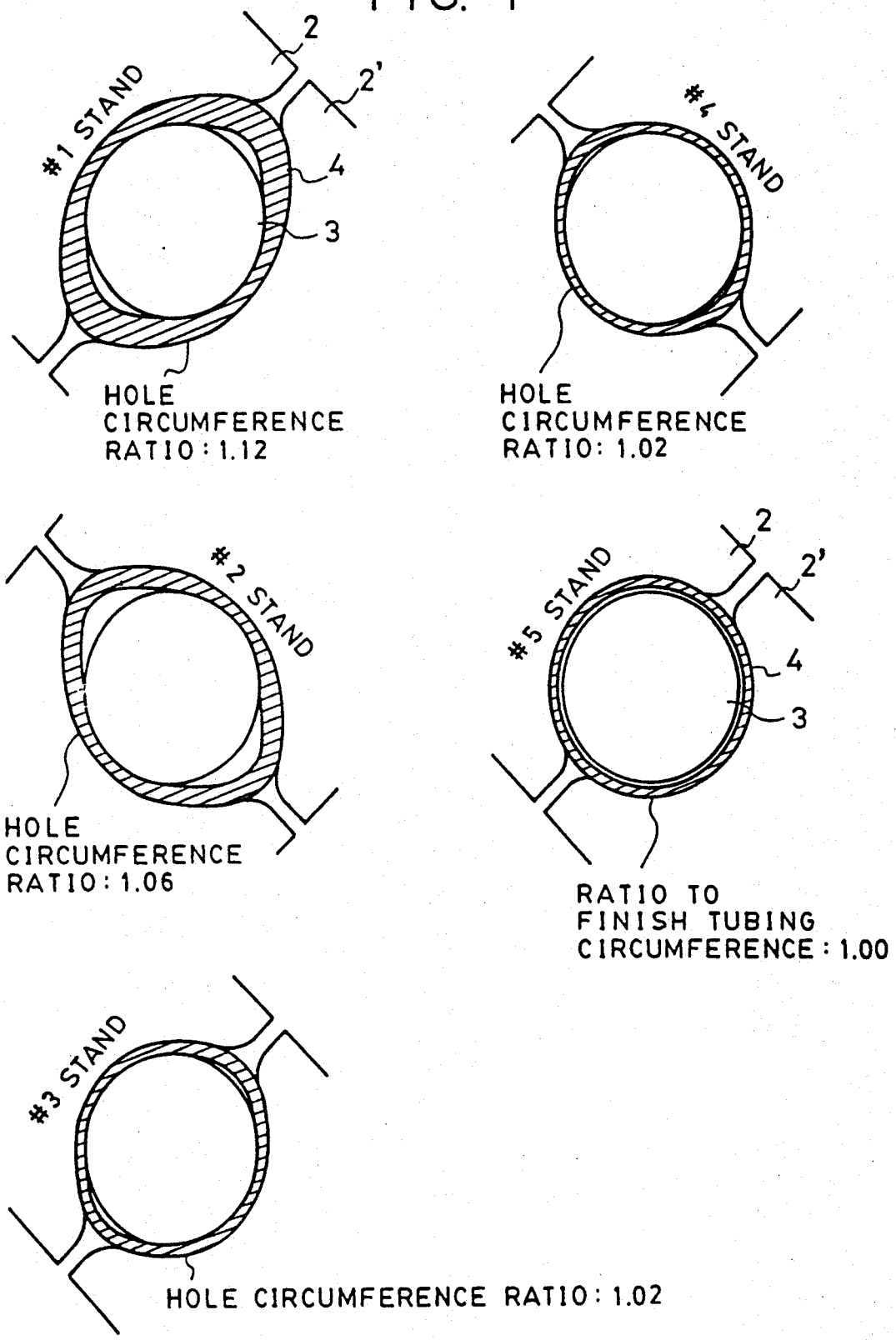
FIG. 1 is a view schematically showing a typical example of the arrangement of roll grooves according to the present invention.

A mandrel mill according to the present invention had a serial arrangement of the paired grooves of rolls of a plurality of stands (#1 to #5 stands), such as that shown in FIG. 1. Rolling experiments were conducted under the conditions shown in Table 1 below. In these experiments, the mandrel mill of the present invention and another mandrel mill (comparison mill) having a different arrangement of roll grooves (shown in Table As will be understood from the results of the experiments shown in Table 2, the mandrel mill according to the present invention provided an outer circumference of the rearward end portion of the tubing material which was 3 mm longer than that provided by the comparison mill. It is considered that the tubing material in its hot rolled state immediately after the rolling had an inner diameter approximately 2 mm longer than the diameter of the mandrel bar, allowing an appropriate clearance between the mandrel bar and the tubing material. While a load of approximately 10 tons was necessary with the comparison mill to draw the mandrel bar, a considerably lower load of less than 1 ton was necessary for the same purpose with the mandrel mill according to the present invention. While the rolling with the comparison mill resulted in ten out of fifty tubings having scratched inner surfaces, the rolling with the mandrel mill according to the present invention resulted in none out of fifty tubings having scratched inner surfaces.

EXAMPLE 2

Rolling experiments were conducted by employing an eight-stand tandem mandrel mill which was actually used in production (hereinafter referred to as "field mandrel mill"), and by rolling shells having an outer diameter of 146 mm and a wall thickness of 7.0 mm with a serially arranged roll stands having grooved rolls of three different standards. The mandrel mill had basic specifications such as those shown in Table 3. The rolling experiments adopted certain common conditions shown in Table 4. Further, the rolling experiments adopted different sets of hole circumference ratios, which constituted Experiment Conditions 1, 2 and 3, shown in Table 5.

TABLE 3

| BASIC SPECIFICATIONS OF FIELD MANDREL MILL | |
|---|---|
| MILL TYPE | FULL FLOAT |
| NUMBER OF STANDS | 8 |
| DISTANCE BETWEEN STANDS | 1120 mm |
| DIAMETER OF ROLL FLANGES | 560 to 480 mm |
| MAXIMUM SHELL LENGTH | 24000 mm |
| MANDREL BAR LENGTH | 22400 mm |
| BAR STRIPPER MOTOR CAPACITY | DC 110 kw × 2 |

TABLE 4

| COMMON EXPERIMENT CONDITIONS | |
|---|---|
| ROLLING MATERIAL | ORDINARY CARBON STEEL |
| ROLLING TEMPERATURE | 1200° C. AT MILL ENTRANCE, 1000° C. AT MILL EXIT |
| MANDREL BAR MATERIAL | SKD61 |
| MANDREL BAR LUBRICANT | WATER-DISPERSABLE GRAPHITE-TYPE LUBRICANT |

TABLE 5

FIELD MANDREL MILL ROLLING EXPERIMENT CONDITIONS (HOLE CIRCUMFERENCE RATIOS)

| EXPERIMENT CONDITIONS | STAND NO. | | | | | | | |
|---|---|---|---|---|---|---|---|---|
| | # 1 | # 2 | # 3 | # 4 | # 5 | # 6 | # 7 | # 8 |
| 1 | 1.080 | 1.040 | 1.020 | 1.020 | 1.020 | 1.020 | 1.020 | 1.000 |
| 2 | 1.110 | 1.055 | 1.020 | 1.020 | 1.020 | 1.020 | 1.020 | 1.000 |
| 3 | 1.120 | 1.060 | 1.020 | 1.020 | 1.020 | 1.020 | 1.020 | 1.000 |

When stripping the mandrel bar, the current value of a mandrel bar stripper motor was checked. The results are shown in Table 6. Although no reduction in the stripping force was achieved when the hole circumference ratio of the first-stand rolls was 1.11 (Experiment Condition 2), the stripping force was greatly reduced when that ratio was increased to 1.12 (Experiment Condition 3). With Experiment Condition 3, the mandrel bar was successfully stripped all the time.

TABLE 6

| MANDREL BAR STRIPPER MOTOR CURRENT VALUE | | | |
|---|---|---|---|
| EXPERIMENT CONDITION | 1 | 2 | 3 |
| MOTOR CURRENT VALUE (A) | 1200 | 1200 | 300 |

As has been described above, according to the present invention, in a serial arrangement of paired grooves of rolls of a mandrel mill, the hole circumferences of the rolls of upstream stands are designed to be equal to or greater than certain limit values. In this way, it is possible, without the need to equip the currently used mandrel mill with an additional device, to form an appropriate clearance between the mandrel bar and the tubing material even at the forward and rearward end portions of the tubing material which have hitherto tended to closely contact with the mandrel bar throughout the circumference thereof. The formation of an appropriate clearance prevents scratch-formation on the inner surface of a tubing material or stripping miss. Consequently, it is possible to greatly improve the yield and the rate of operation of the mandrel mill.

What is claimed is:

1. A mandrel mill capable of preventing stripping miss, comprising:

a plurality of roll stands serially arranged, each roll stand comprising a plurality of pairs of grooved rolls whose grooves are paired, said plurality of roll stands defining a serial arrangement of said paired grooves; and a mandrel bar disposed in and extended through said serial arrangement in a spaced relationship with said grooved rolls, said mandrel bar cooperating with said rolls to define therebetween a pass for rolling a tubing therein, wherein said plurality of stands include a first stand whose rolls have grooves defining a hole of a circumference of not less than 1.12 times the outer circumference of a tubing at the exit of the final stand, a second stand whose rolls have grooves defining a hole of a circumference of not less than 1.06 times said outer circumference, and a third stand whose rolls have grooves defining a hole of a circumference of not less than 1.02 times said outer circumference.

* * * * *